US005431314A

United States Patent [19]

Bonnelye et al.

[11] Patent Number: 5,431,314

[45] Date of Patent: Jul. 11, 1995

[54] DROPPER ADAPTOR WITH IMPROVED CHANNEL CONFIGURATION, AND BOTTLE EQUIPPED WITH SUCH AN ADAPTOR

[75] Inventors: Jean Bonnelye, Offranville; Jean-François Chatelier, Dieppe; Jean-François Gregoire, Rouxmesnil Bouteilles, all of France

[73] Assignee: Kerplas S.N.C., Dieppe Cedex, France

[21] Appl. No.: 138,969

[22] Filed: Oct. 21, 1993

[30] Foreign Application Priority Data

Oct. 21, 1992 [FR] France ..... 92 12602

[51] Int. Cl.[6] ..... B65D 47/18

[52] U.S. Cl. ..... 222/420; 222/575; 604/295; 604/298

[58] Field of Search ..... 222/212, 420, 575; 239/601; 604/294–302

[56] References Cited

U.S. PATENT DOCUMENTS

| | | | |
|---|---|---|---|
| 2,188,802 | 1/1940 | Beckett | 222/420 |
| 2,945,458 | 7/1960 | Setecka | 222/575 X |
| 2,968,262 | 1/1961 | Lacey | 222/575 X |
| 4,927,062 | 5/1990 | Walsh | 604/295 X |
| 5,219,101 | 6/1993 | Matkovich et al. | 222/420 X |

FOREIGN PATENT DOCUMENTS

| | | |
|---|---|---|
| 0431885 | 6/1991 | European Pat. Off. . |
| 162533 | 9/1905 | Germany . |
| 1318677 | 5/1973 | United Kingdom . |

*Primary Examiner*—Gregory L. Huson

*Attorney, Agent, or Firm*—Wenderoth, Lind & Ponack

[57] ABSTRACT

A bottle for liquids is fitted with a dropper adaptor including a plastic body having extending longitudinally therethrough a flow channel. Over at least a first length portion thereof the flow channel has a cross section in the shape of a star with at least three branches. The channel opens outwardly from the body only at an outlet aperture at an outlet end of the flow channel and at an inlet aperture, defined by plural windows, at an internal end of the flow channel.

26 Claims, 2 Drawing Sheets

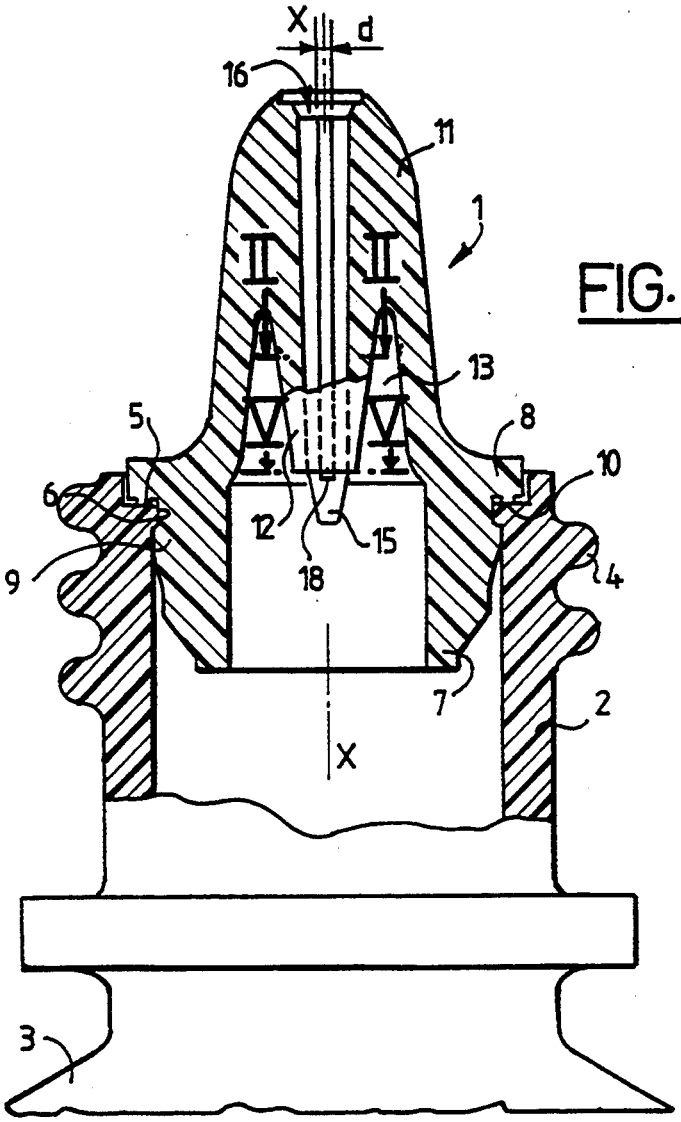
FIG.1
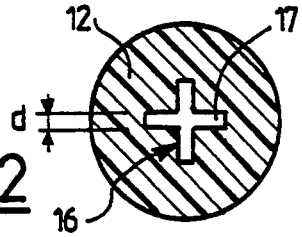
FIG.2
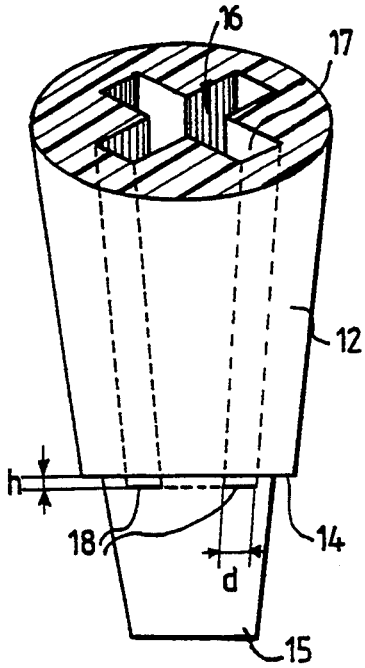
FIG.3
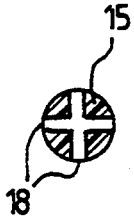
FIG.5
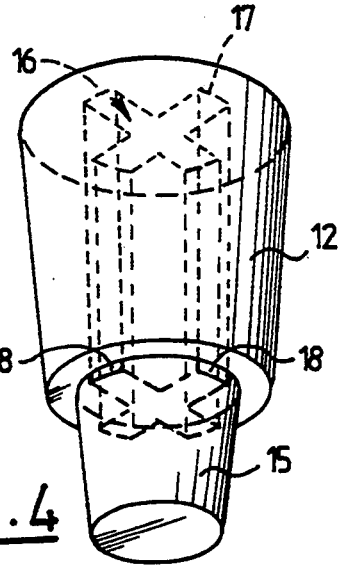
FIG.4
FIG.6
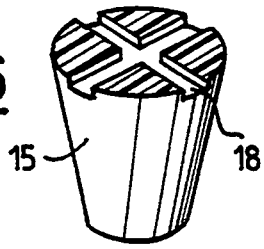

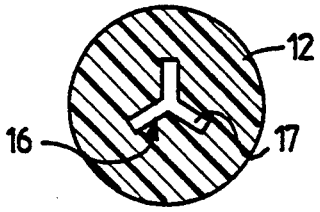
FIG.7
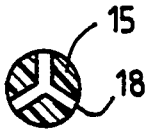
FIG.10
FIG.8
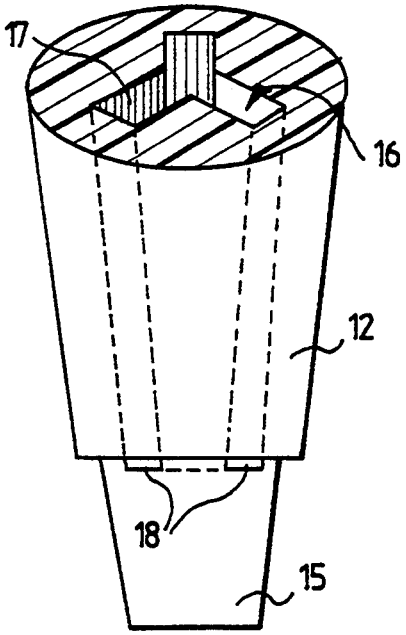
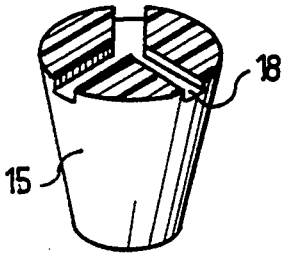
FIG.11
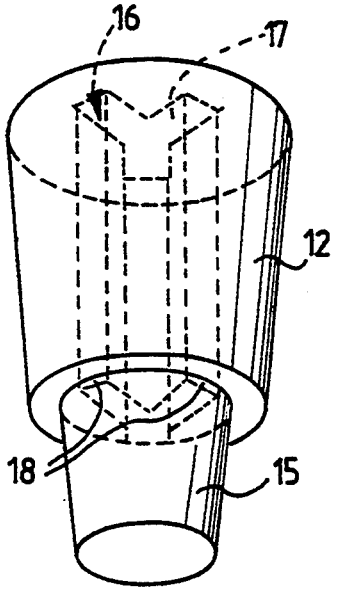
FIG.9
FIG.12
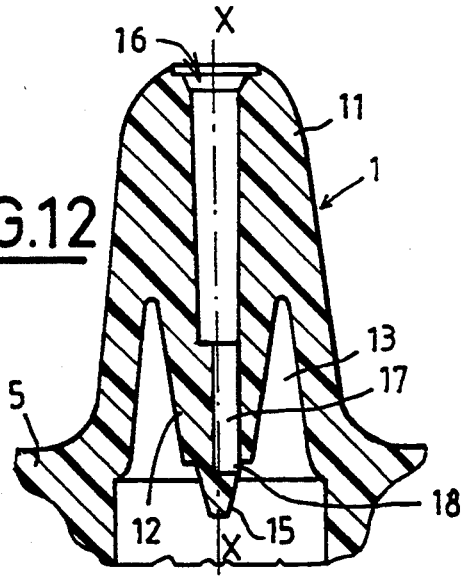

DROPPER ADAPTOR WITH IMPROVED CHANNEL CONFIGURATION, AND BOTTLE EQUIPPED WITH SUCH AN ADAPTOR

BACKGROUND OF THE INVENTION

The present invention relates to a dropper adaptor for a bottle, of the type comprising a plastic body passed through longitudinally by a flow channel.

Adaptors of this type, intended in particular to be fitted to bottles of ophthalmological products, should be capable of delivering the product dropwise, without pressure, even if the user creates a relatively high pressure in the bottle, which is generally made of flexible plastic.

In order to obtain an adaptor at a low cost price, it is sought to produce the channel so that the channel itself creates the head loss necessary for obtaining the dropper function. For this purpose, in the conventional technique, the channel is generally made with a circular cross section with a diameter that decreases inwards, that is to say towards the inside of the bottle in use, the entry diameter of the channel being of the order of 0.2 mm for example.

Now, in practice, it is difficult to obtain such channels reliably in industry with a high production rate. In fact, it is necessary to arrange in the injection mold of the adaptor a needle whose tip is correspondingly fine, and a non-negligible frequency of breakage of the needle is observed during injection of the plastic.

SUMMARY OF THE INVENTION

The object of the invention is to allow dropper adaptors to be produced in industry very reliably and at a high rate.

For this purpose, the subject of the invention is a dropper adaptor of the aforementioned type, characterized in that, over at least part of its length, the channel has, in cross section, the shape of a star with at least three branches.

According to other characteristics:

- each branch of the star forms a capillary duct over at least part of its length;
- the mid plane of each branch of the star extends substantially radially;
- each branch of the star has faces substantially parallel to each other;
- at its internal end, each branch of the star is closed axially and emerges radially into a free space through a window;
- the circumferential dimension of each window is greater than its axial dimension;
- the axially internal part of the channel is made in a central protuberance of the body around which an annular space is defined;
- from the windows, the protuberance is extended inwards in the form of an appendage having a reduced diameter;
- the channel has a star shape only over a portion of its length, in particular from its axially internal end, and, in its part situated downstream of this portion of length, the channel has a greatly widened, in particular circular, passage cross section.

The subject of the invention is also a bottle for liquids, in particular made of a flexible plastic, fitted with a dropper adaptor as defined hereinabove.

BRIEF DESCRIPTION OF THE DRAWINGS

Embodiments of the invention will now be described with reference to the attached drawings, in which:

FIG. 1 represents, in longitudinal section, an adaptor according to the invention, shown mounted on a bottle;

FIG. 2 is a partial cross section of such adaptor, taken along the line II—II in FIG. 1;

FIG. 3 represents, in elevation, the internal part of the central protuberance of the adaptor, with an oblique section corresponding to the line II—II in FIG. 1;

FIG. 4 is a perspective view from below of the subject matter of FIG. 3;

FIG. 5 is a partial cross section of the adaptor in FIG. 1, taken along the line V–V in FIG. 1;

FIG. 6 is a perspective view of the part of the central protuberance of the adaptor which is situated below the section line V—V in FIG. 1;

FIGS. 7 to 11 are views corresponding respectively to FIGS. 2 to 6, but relating to a variant of the adaptor in FIG. 1; and FIG. 12 represents, in axial section, another variant of the adaptor according to the invention.

DETAILED DESCRIPTION OF THE INVENTION

The adaptor 1 represented in FIGS. 1 to 6 is intended to be fitted to the neck 2 of a bottle 3, typically made of flexible plastic. The neck 2 is provided with an external screw thread 4 for screwing on a cap, not shown, and includes at its free end a countersink 5 bordered on the inside by a flange 6.

It will subsequently be assumed that the axis X-X of the adaptor is arranged vertically and that the adaptor is above the bottle, as shown. As regards the adaptor, the side situated towards the inside of the bottle will be called "internal" and the opposite side will be called "external".

The adaptor 1, molded in a single piece of injected plastic, includes a tubular base 7 which terminates towards the outside in an external collar 8 accommodated in the countersink 5. A circular flange 9 in radial projection, situated at a short distance under collar 8, allows the base 7 to be inserted into the opening of the neck, while a circular flange 10 in axial projection under the collar 8 ensures leaktightness by interacting with the upper face of the countersink.

Above the base 7, the adaptor forms an annular body 11 of approximately conical shape which converges upwards. From approximately half way up this body, a central protuberance 12 surrounded by an annular space 13 projects downwards. This protuberance has a substantially frustoconical external shape, converging downwards, as far as the collar 8, then forms a horizontal shoulder 14 then a lower appendage 15 which is also frustoconical and converges downwards, but which has a reduced diameter.

A flow channel 16 passes through the body 11 from its upper end as far as the shoulder 14. This channel has in cross section the shape of a regular star with four radial branches 17, that is to say of a cross. The mid plane of each branch contains the central axis X-X of the adaptor, and the two side faces of each branch are substantially parallel to each other. The separation d (FIG. 2) between these two faces is sufficiently small, depending on the liquid to be dispensed, to create a capillary effect. The cross section of the channel 16 decreases slightly from the top downwards, to form a taper which facilitates mold release.

As is seen in FIGS. 3 and 4, where the proportions have intentionally not been respected, the channel 16 is extended over a very small distance h less than d below the shoulder 14, and, at this level, each branch of the channel emerges radially onto the peripheral surface of the appendage 15 through a window 18. Each window 18 thus has a circumferential dimension greater than its height.

By way of numerical example, it is possible to choose d=0.3 mm at the top of the channel 16 and 0.2 mm at its lower end, and h=0.05 mm.

Furthermore, in this example, the free end of the channel has, over a short length, a circular cross section.

In order to produce the adaptor 1, a needle of cruciform cross section matching the channel 16, and a backing piece which defines the windows 18 by interacting with the lower end of this needle, are used. No additional mold piece is necessary, and the cruciform needle has high inertia which allows it to be highly resistant to buckling and bending during the injection of the plastic.

In addition, dimensioning of the channel 16 is easily achieved which makes it possible to obtain, during use of the bottle, two essential advantages:

on the one hand, a head loss markedly greater than those observed with conventional circular channels; and on the other hand, an absence of blocking of the channel 16 due to crystallization of the liquid under the effect of the pressure produced in the bottle, in contrast to what happens with a central circular channel.

The embodiment of FIGS. 7 to 11 differs from the preceding embodiment only in that the channel 16 forms a regular star with three branches 17. By way of numerical example, it was possible to choose d=0.2 mm at the top of the channel and 0.1 mm at its lower end, and h=0.05 mm, and a head loss was observed which was markedly greater still than that obtained with the variant described hereinabove with reference to FIGS. 1 to 6.

The embodiment in FIG. 12 differs from that in FIGS. 7 to 11 only in that the channel 16 has a star shape only over a portion of its length, for example over a third of its length, from its internal end, that is to say from the windows 18. Beyond this point, that is to say over the rest of its length, the channel 16 has a considerably widened circular cross section, with a diameter typically of the order of one millimeter.

It was observed that this embodiment has several advantages:

the needle for forming the channel 16 is easier to produce, and mold release of the adaptor is easier;

the overall head loss of the channel, resulting partly from the practically radial entry of the liquid towards the axis X-X through the windows 18, partly from the capillary effect of the branches 17, and partly from the pressure reduction effect which results from the sharp increase in the passage cross section at the exit of these branches 17, is greater than that which is obtained with the embodiment in FIGS. 7 to 11;

quite surprisingly, when the user releases the bottle after dispensing a dose of product, the drop sucked back into the bottle contains a small quantity of air which has a highly favorable effect on the time for which the product can be kept.

We claim:

1. A dropper adaptor for a bottle, said adaptor comprising:

a plastic body having therein a longitudinal flow channel;

said flow channel having over a first length portion thereof a cross section in the shape of a star with at least three branches; and said flow channel having over a second length portion thereof, located downstream of said first length portion, a greatly widened passage cross section.

2. An adaptor as claimed in claim 1, wherein said first length portion extends from an upstream axially internal end of said flow channel.

3. An adaptor as claimed in claim 1, wherein said second length portion extends from said first length portion to a downstream axially external end of said flow channel.

4. An adaptor as claimed in claim 1, wherein said greatly widened passage cross section is circular.

5. In a bottle for liquids and fitted with a dropper adaptor, the improvement wherein said adaptor comprises:

a plastic body having therein a longitudinal flow channel;

said flow channel having over a first length portion thereof a cross section in the shape of a star with at least three branches; and said flow channel having over a second length portion thereof, located downstream of said first length portion, a greatly widened passage cross section.

6. The improvement claimed in claim 5, wherein said first length portion extends from an upstream axially internal end of said flow channel.

7. The improvement claimed in claim 5, wherein said second length portion extends from said first length portion to a downstream axially external end of said flow channel.

8. The improvement claimed in claim 5, wherein said greatly widened passage cross section is circular.

9. A dropper adaptor for a bottle, said adaptor comprising:

a plastic body;

a pressure drop creating flow channel extending longitudinally through said body, said flow channel having an axis and being defined throughout substantially the entire axial length thereof by an internal peripheral wall of said body;

said flow channel having a cross section, transverse to said axis, in the shape of a star with at least three branches; and said channel opening from said body only at an inlet aperture at an internal end thereof and at an outlet aperture at an outlet end thereof.

10. An adaptor as claimed in claim 9, wherein each said branch of said star forms a capillary duct over its length.

11. An adaptor as claimed in claim 9, wherein a mid plane of each said branch of said star extends substantially radially.

12. An adaptor as claimed in claim 9, wherein each said branch of said star has faces substantially parallel to each other.

13. An adaptor as claimed in claim 9, wherein an axially internal portion of said flow channel is formed in a central protuberance of said body around which is defined an annular space.

14. An adaptor as claimed in claim 9, wherein said internal peripheral wall of said body defines said star shape throughout substantially said entire axial length of said flow channel.

15. An adaptor as claimed in claim 9, wherein each said branch of said star has an internal end that is closed axially and that emerges radially into a free space through a window defining said inlet aperture.

16. An adaptor as claimed in claim 15, wherein a circumferential dimension of each window is greater than an axial dimension thereof.

17. An adaptor as claimed in claim 15, wherein an axially internal portion of said flow channel is formed in a central protuberance of said body around which is defined an annular space, said protuberance further including, extended inwardly from windows of said branches, an appendage having a reduced diameter.

18. In a bottle for liquids and fitted with a dropper adaptor, the improvement wherein said adaptor comprises:

a plastic body;

a pressure drop creating flow channel extending longitudinally through said body, said flow channel having an axis and being defined throughout substantially the entire axial length thereof by an internal peripheral wall of said body;

said flow channel having a cross section, transverse to said axis, in the shape of a star with at least three branches; and said channel opening from said body only at an inlet aperture at an internal end thereof and at an outlet aperture at an outlet end thereof.

19. The improvement claimed in claim 18, wherein each said branch of said star forms a capillary duct over its length.

20. The improvement claimed in claim 18, wherein a mid plane of each said branch of said star extends substantially radially.

21. The improvement claimed in claim 18, wherein each said branch of said star has faces substantially parallel to each other.

22. The improvement claimed in claim 18, wherein an axially internal portion of said flow channel is formed in a central protuberance of said body around which is defined an annular space.

23. The improvement claimed in claim 18, wherein said internal peripheral wall of said body defines said star shape throughout substantially said entire axial length of said flow channel.

24. The improvement claimed in claim 18, wherein each said branch of said star has an internal end that is closed axially and that emerges radially into a free space through a window defining said inlet aperture.

25. The improvement claimed in claim 24, wherein a circumferential dimension of each window is greater than an axial dimension thereof.

26. The improvement claimed in claim 24, wherein an axially internal portion of said flow channel is formed in a central protuberance of said body around which is defined an annular space, said protuberance further including extended inwardly from windows of said branches an appendage having a reduced diameter.

* * * * *